United States Patent [19]

Tamura et al.

[11] 4,039,148

[45] Aug. 2, 1977

[54] CONVEYING DEVICE FOR LONG ARTICLES WITHIN HEAT TREATMENT FURNACES

[75] Inventors: Masamitu Tamura; Katsumi Maeda; Nobuhiko Harada; Sigeharu Nakamura, all of Shimonoseki, Japan

[73] Assignee: Kobe Steel Ltd., Kobe, Japan

[21] Appl. No.: 649,150

[22] Filed: Jan. 14, 1976

[30] Foreign Application Priority Data

Jan. 14, 1975 Japan ..... 50-7550

[51] Int. Cl.[2] ..... F27B 9/20

[52] U.S. Cl. ..... 214/21; 198/648; 432/259

[58] Field of Search ..... 214/18, 21; 198/472, 198/648, 822; 432/121, 259, 261

[56] References Cited

U.S. PATENT DOCUMENTS

| | | | |
|---|---|---|---|
| 1,409,584 | 3/1922 | Ross | 214/18 R |
| 2,295,401 | 9/1942 | Hansen | 214/21 |

*Primary Examiner*—Robert G. Sheridan

*Attorney, Agent, or Firm*—Oblon, Fisher, Spivak, McClelland & Maier

[57] ABSTRACT

A conveying device for conveying long articles within heat treatment furnaces, the driving means of which includes a drive mechanism and at least one element of linear form, for conveyance of the articles, driven by means of the drive mechanism. Product carriers are conveyed by means of the linear conveying element, each product carrier having a plurality of product supports for supporting the long articles thereon. The foremost one of the carriers, with respect to the direction of motion, has a means of engaging the linear conveying element whereby the linear conveying element transports the product carriers, and thereby the product supports and the long articles disposed thereon.

13 Claims, 34 Drawing Figures

CONVEYING DEVICE FOR LONG ARTICLES WITHIN HEAT TREATMENT FURNACES

BACKGROUND OF THE INVENTION

1. Field of the Invention

The present invention relates generally to a device for conveying long articles within heat treatment furnaces, and more particularly to the application of such conveyance devices to heat treatment furnaces for imparting a continuous bright annealing treatment to metal pipes and tubes, such as for example, nuclear fuel clad stainless tubes utilized within nuclear power generation plants, for which bright annealing treatment is essential and/or desirable.

2. Description of the Prior Art

Bright annealing treatment, utilizing helium, argon, hydrogen or ammonia gas, is frequently applied to metal products, such as, for example, wire, pipe, and the like, made of zirconium and its alloys, nickel and its alloys, stainless steel, and similar metals. For especially high-grade precision pipes, such as, for example, nuclear fuel clad tubes to be utilized within nuclear power generating plants, bright annealing treatment, as at least the final annealing treatment, is a necessity due to the fact that the bright annealing treatment eliminates the adhesion of fluorides and chlorides to the pipes, which occur during descaling, whereby picking and washing processes become unnecessary. Bright annealing therefore offers the advantages of permitting continuous processing, and achieving product surface conditions which are closest to the final polished state.

When performing bright annealing treatment upon nuclear fuel clad stainless tubes or similar tubes and pipes, the treatment must not produce any flaws within the product, nor cause any precipitaton of chromium carbide during cooling of the product. There exists a strict standard for nuclear fuel clad stainless tubes which requires that surface flaws should not exceed 25 $\mu$ and that there should be a minimum precipitation of chromium carbide. Nevertheless, within conventional devices employed for the conveyance of long articles within bright annealing furnaces, it is difficult to obtain good results, flaws often being produced upon the external surface of the product, chromium carbide precipitation is detected, and changes in the grain size of austenite phases within the metal also occur.

In addition, the mesh belt utilized within these product conveyance devices frequently becomes elongated thereby becoming unevenly wound about the driving part of the device.

SUMMARY OF THE INVENTION

Accordingly, it is an object of the present invention to provide an improved conveying device, for long articles to be operated within a heat treatment furnace.

Another object of the present invention is to provide an improved conveying device which will effectively perform heat treatment of long articles and will improve the efficiency thereof by solving the aforementioned problems.

In order to achieve the foregoing and other objects, the present invention contemplates to provide an improved conveying device, for long articles, to be operated within a heat treatment furnace wherein the device has a carrier which carries long articles thereon, and a driving means for moving the carrier. The driving means includes a drive mechanism, and a linear conveying element driven by means of the drive mechanism. The carrier has an engaging element adapted to engage the linear conveying element, and with this arrangement, the long articles carried upon the carrier are conveyed by means of the linear conveying element driven by means of the drive mechanism, with the engaging element engaged with the linear conveying element.

More specifically, in the instance that the conveying device is employed within a bright annealing furnace, wherein a heating cylinder and cooling cylinder are installed approximately in line with each other, at least one product carrier is provided along the linear conveying element. The carriers are connected together by means of a linear element, such as, for example, a rod, wire, or chain, and the long articles are carried upon the long-article supports of the carrier which are also arranged in a line. The engaging element of the carrier engages the linear conveying element which is driven by means of the drive mechanism, and thus, the long articles are successively conveyed through the heating cylinder and the cooling cylinder. The engaging element may comprise a hook or clip, and the linear conveying element may comprise a wire, chain, or rod.

With the arrangement noted hereinabove, the article conveying device for the heat treatment is improved, and in addition, due to the decreased heat capacity of the conveying device, rapid heating and quenching of the long articles can be properly performed. Another advantage of the arrangement of the present invention is that the productivity is highly improved through treatment of many pieces at one time.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

Figure 1:
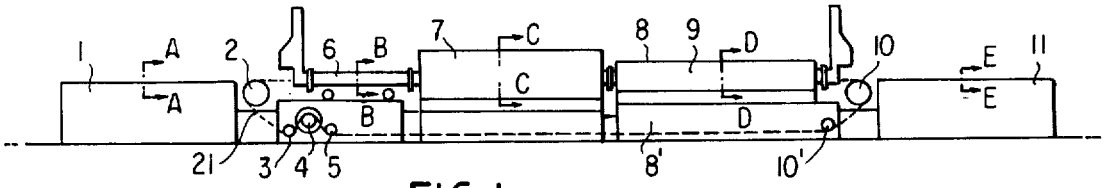
FIG. 1 PRIOR ART
FIG. 1 is a schematic view of an example of a conventional bright annealing furnace.
Figure 1A:
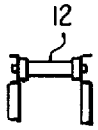
FIG. 1a PRIOR ART
Figure 1B:
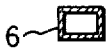
FIG. 1b PRIOR ART
Figure 1C:
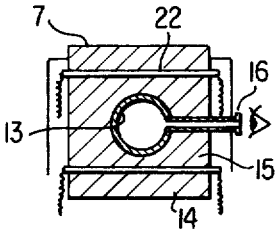
FIG. 1c PRIOR ART
Figure 1D:
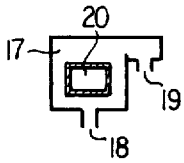
FIG. 1d PRIOR ART
Figure 4:
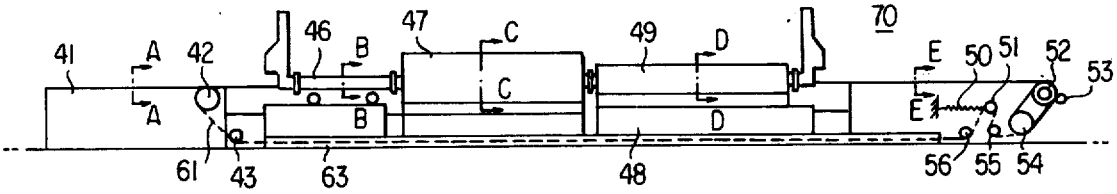
Figure 4A:
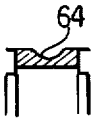
Figure 4B:
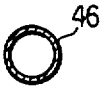
Figure 4C:
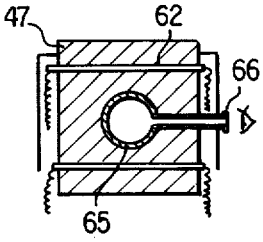
Figure 4D:
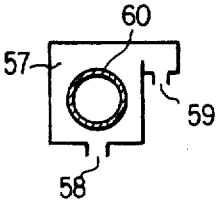
Figure 2:
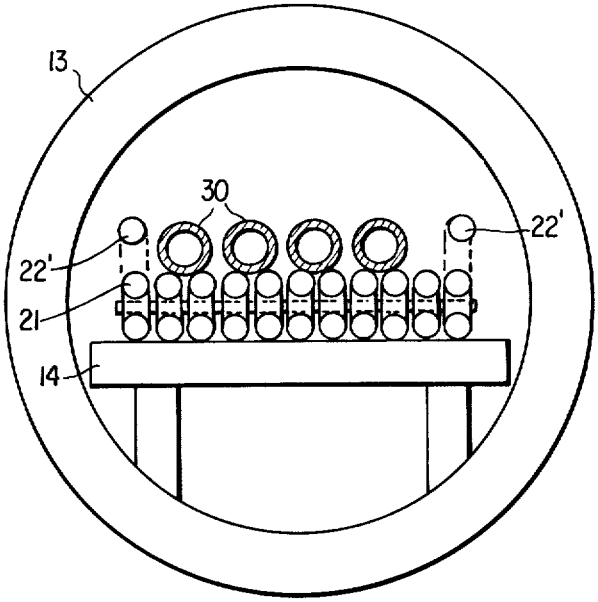
FIG. 2 PRIOR ART
Figure 3A:
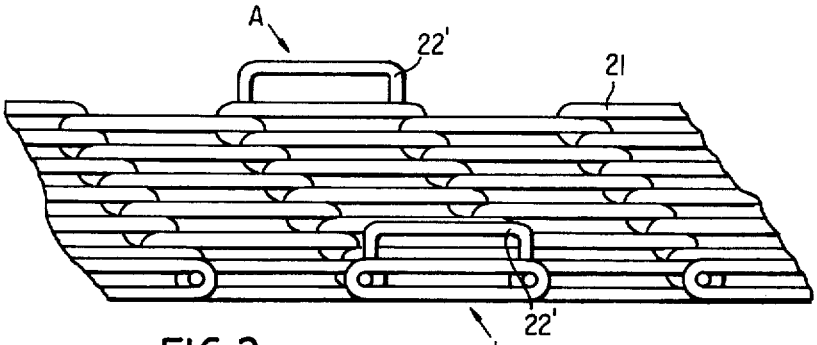
FIG. 3a PRIOR ART
Figure 3B:
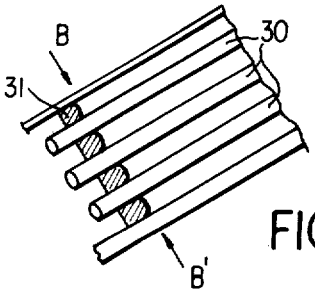
Figure 5A:
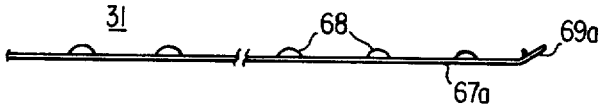
Figure 5B:
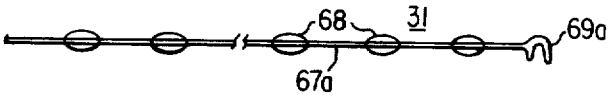

FIG. l*a* is a cross-section view of the apparatus of FIG. 1 taken along lines A—A and E—E of FIG. 1;

FIG. 1*b* is a cross-section view of the apparatus of FIG. 1 taken along line B—B of FIG. 1;

1*c* is a cross-section view of the apparatus of FIG. 1 taken along line C—C of FIG. 1;

FIG. 1*d* is a cross section view of the apparatus of FIG. 1 taken along line D—D of FIG. 1;

FIG. 2 is a partial, enlarged cross-sectional view of the heating cylinder of FIG. 1*c*;

FIGS. 3*a* and 3*b* are fragmentary perspective views of the mesh belt mechanism of the furnace shown within FIG. 1;

FIG. 4 is a schematic view of a bright annealing furnace incorporating a conveying device constructed in accordance with the present invention and showing its cooperative parts;

FIG. 4*a* is a cross-section view of the apparatus of FIG. 4 taken along lines A—A and E—E of FIG. 4;

FIG. 4*b* is a cross-section view of the apparatus of FIG. 4 taken along line B—B of FIG. 4;

FIG. 4*c* is a cross-section view of the apparatus of FIG. 4 taken along line C—C of FIG. 4;

FIG. 4*d* is a cross-section view of the apparatus of FIG. 4 taken along line D—D of FIG. 4;

FIG. 5*a* is a schematic side elevation view of a carrier element utilized within the device of the present invention;

FIG. 5*b* is a plan view of the carrier of FIG. 5*a;*

Figure 5C:
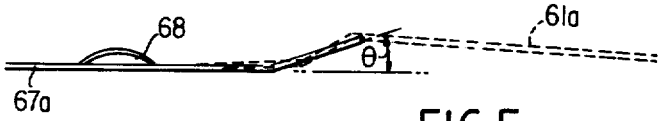
Figure 5D:
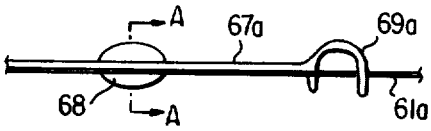

FIG. 5*c* is a schematic side elevation view of the carrier of FIG. 5*a* engaged with a wire conveying element of the device of the present invention;

FIG. 5*d* is a plan view of the engaged apparatus of FIG. 5*c;*

Figure 5E:
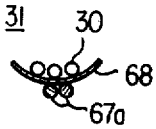

FIG. 5*e* is a cross-sectional view of the apparatus of FIG. 5*d;*

Figure 5G:
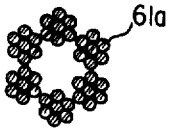
Figure 5F:
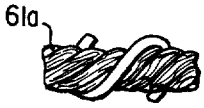

FIG. 5*f* is a side elevation view of the conveying element of FIG. 5*c;*

FIG. 5*g* is a cross-sectional view of the element of FIG. 5*f;*

Figure 6:
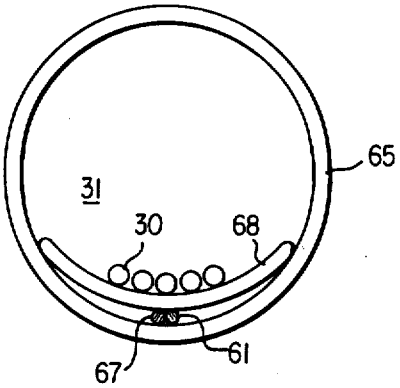
Figure 7:
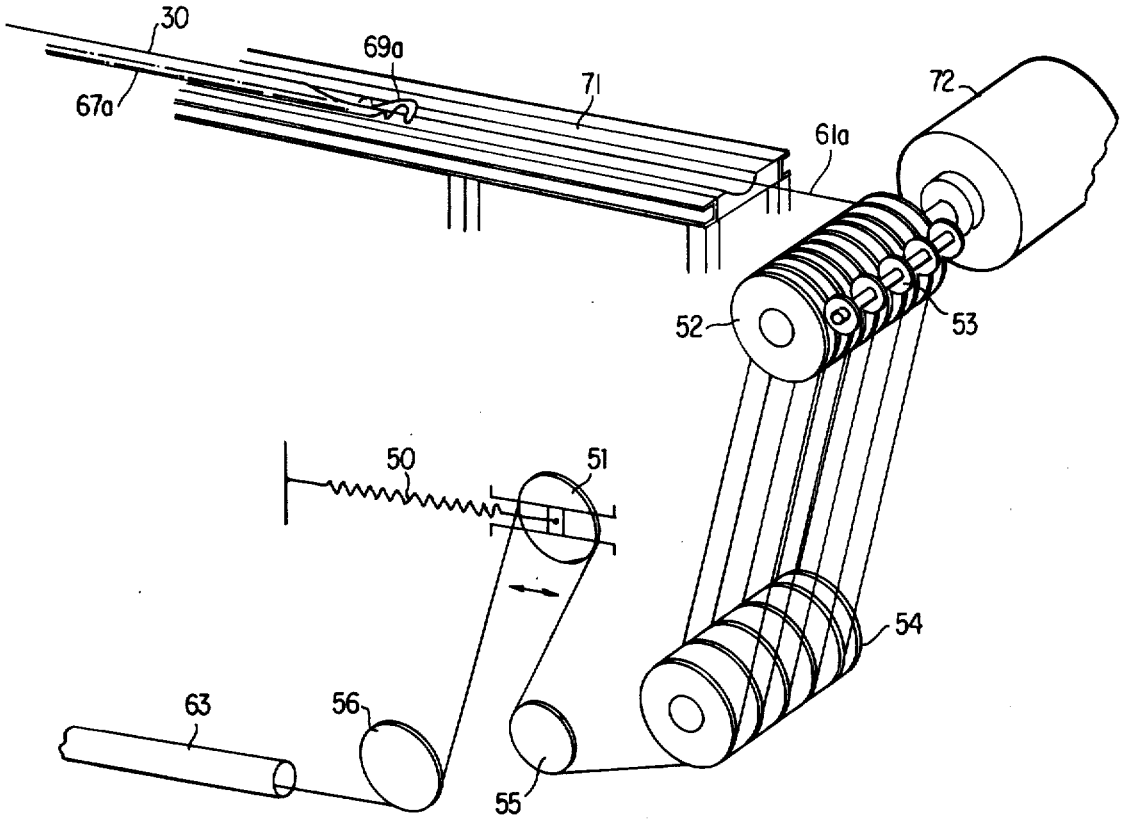
Figure 8A:
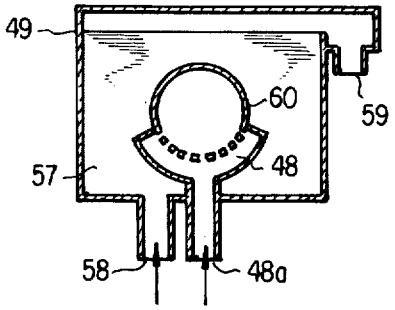
Figure 8B:
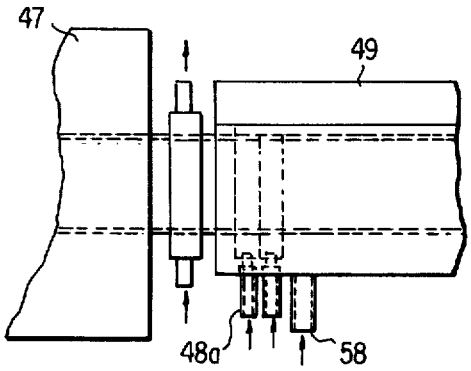
Figure 8C:
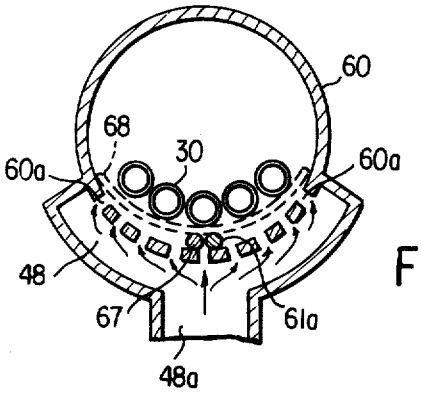

FIG. 6 is an enlarged cross-sectional view of the cooling chamber of FIG. 4 taken along line C—C of FIG. 4;

FIG. 7 is an enlarged, fragmentary perspective view of the drive mechanism forming a part of the device shown within FIG. 4;

FIG. 8*a* is an enlarged cross-sectional view of the cooling cylinder of FIG. 4 taken along line D—D of FIG. 4;

FIG. 8*b* is an enlarged, fragmentary schematic view of the heating and cooling cylinders of FIG. 4;

FIG. 8*c* is an enlarged, partial cross-sectional view of the cooling chamber of FIG. 8*a;*

Figure 9A:
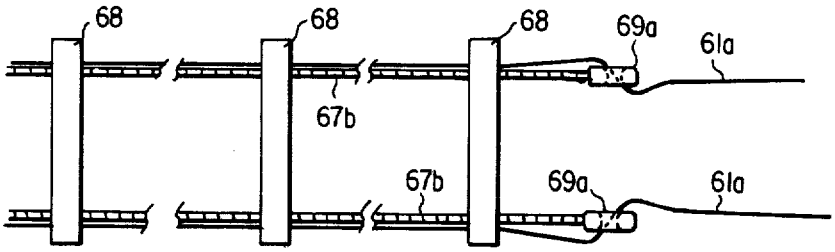
Figure 9B:
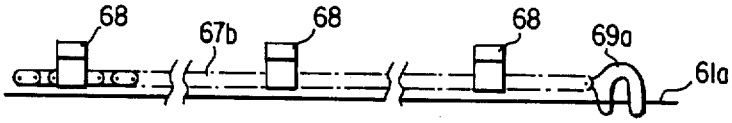

FIG. 9*a* is a schematic plan view of another embodiment of the conveying means forming a part of the device of FIG. 4;

FIG. 9*b* is a side elevation view of the conveying means of FIG. 9*a;*

Figure 10A:
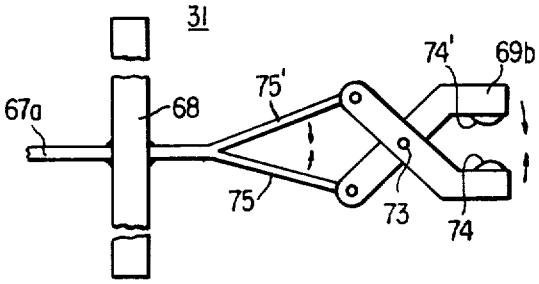
Figure 10B:
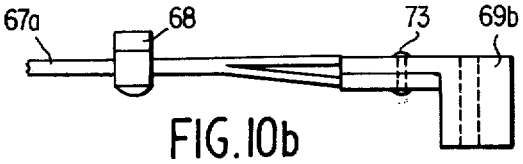

FIG. 10*a* is a fragmentary schematic plan view of another embodiment of an engaging means forming part of the device shown within FIG. 4;

FIG. 10*b* is a side elevation view of the apparatus of FIG. 10*a;*

Figure 10C:
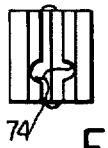

FIG. 10*c* is an end elevation view of the apparatus of FIG. 10*b;*

Figure 11A:
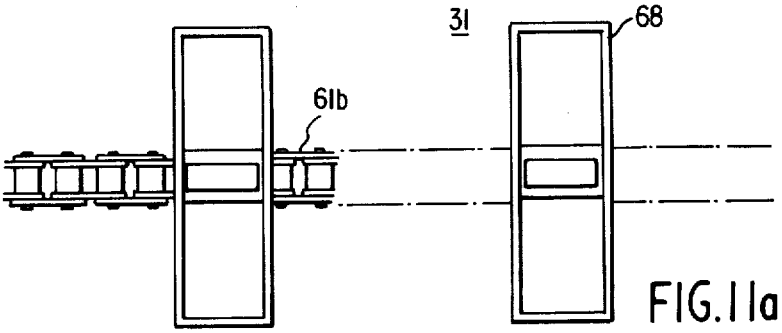
Figure 11B:
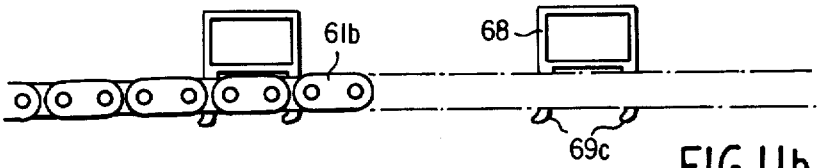

FIG. 11*a* is a schematic plan view of another embodiment of the conveying linear element of the device shown within FIG. 4;

FIG. 11*b* is a side elevation view of the apparatus of FIG. 11*a;*

Figure 11C:
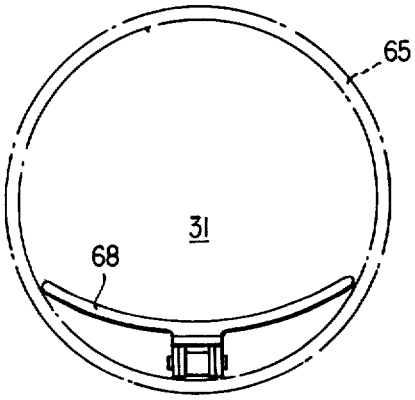
Figure 12:
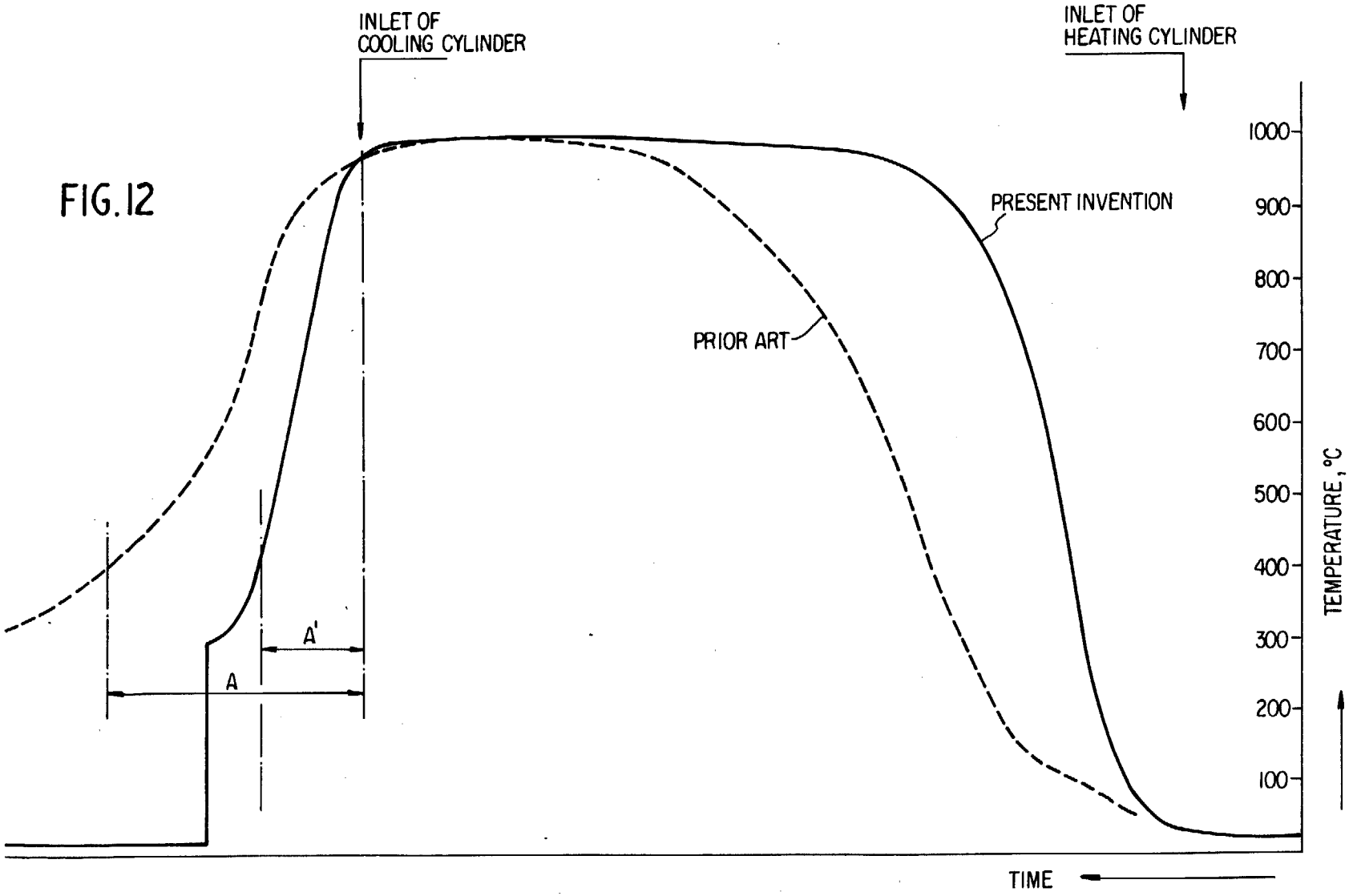

FIG. 11*c* is an end elevation view of the apparatus of FIG. 11*b* within a heating cylinder; and FIG. 12 is a graphical representation of the temperature variations as a function of time, during the heating and cooling steps performed in accordance with the prior art and the present invention.

DETAILED DESCRIPTION OF THE ILLUSTRATED EMBODIMENTS

Referring now to the drawings, and more particularly to FIGS. 1-3 thereof, there is shown an example of a conventional bright annealing furnace, for nuclear fuel clad stainless tubes, which has been developed from the type of bright annealing furnace for stainless steel wire which has been in use for some time. Within FIG. 1, there is installed, successively in line, a product setting table 1 for loading the product, a cleaning cylinder 6 for flushing air from the inner face of the tube prior to the treatment thereof, a heating cylinder 7, a cooling cylinder 9, and a delivery table 11 for receiving the product after annealing of the same. A mesh belt 21 extends along the product flow path from the cleaning cylinder 6 to the heating cylinder 7 and cooling cylinder 9, and the same is carried and guided by means of charging-side guide wheels 2, adjustment wheels 3, driving wheels 4, holding wheels 5, and delivery-side guide wheels 10 and 10', the belt serving to convey the product while permitting free circulation of gas therearound.

As shown within FIG. 2, tubes 30 are loaded upon the mesh belt 21, and the air within the tubes or pipes is flushed out by means of the cleaning cylinder 6. The tubes are then heated while passing through a retort 13 within heating cylinder 7, and they subsequently enter cooling cylinder 9 where they are cooled. In this manner, the tubes undergo rapid heating and quenching treatments within a gas atmosphere of, for example, hydrogen, supplied through means of gas feed outlets 8 and 8' disposed at the entrance to cooling cylinder 9. With the bright annealing treatment thus completed, the product is removed from cylinder 9 and disposed upon the delivery table 11.

As illustrated within FIG. 1*c*, the heating cylinder 7 is fabricated of heat insulating refractory brick 15 and the retort 13 is installed within the central portion thereof. The brick cylinder 7 also includes the rail 14 of the mesh belt 21, and an observation passageway 16, which is operatively connected to retort 13, as well as the heating medium 22, is also provided. As seen within FIG. 1*d*, the cooling cylinder 9, used for quenching the product, contains a cooling water jacket 17 which has a cooling water inlet 18 and a cooling water outlet 19, and the jacket surrounds a chamber 20 provided within the central portion of the cylinder. FIG. 1*a* illustrates the product setting table 1 and the product delivery table 11, which includes rows of guide rollers 12, and FIG. 1*b* illustrates the cleaning cylinder 6.

FIG. 3 shows the mesh belt 21 of the conveying device for long articles utilized within the prior art as installed within a heat treatment furnace. Along each longitudinal side edge of the belt 21, vertically disposed lugs 22' are provided with suitable longitudinal spacing between successive lugs, and a product carrier 31, made of, for example, stainless steel plate, is mounted upon the belt 21. A plurality of tubes 30 are loaded upon the mesh belt 21, and more particularly, upon the carrier 31 thereof, and the loaded pipes are moved together along with the belt 21, FIG. 2 showing the tubes and the mesh belt 21 moving within the retort 13.

Within a furnace of the aforenoted type, the tubes 30 are initially disposed upon the product setting table 1, and subsequently the tubes are advanced into the cleaning cylinder 6 as a result of being transported upon mesh belt 21. The mesh belt 21 is driven by means of a driving wheel 4, and the speed thereof can be freely adjusted. An atmosphere of hydrogen gas is maintained within the heating cylinder 7 by means of a supply of hydrogen gas from supply openings 8 and 8', and after the pipes have entered the cleaning cylinder 6, the air interiorly thereof is flushed out by means of the hydrogen gas within the cleaning cylinder 6 which leads or opens into the heating cylinder 7. This is necessary, for when ammonia or hydrogen gas is used for heating the product, any air remaining within the pipes can result in the formation of an explosive gaseous mixture.

The pipes subsequently pass through the retort 13 of the heating cylinder 7, and thereby become heated to a predetermined temperature within a predetermined period of time. The pipes then exit out of the heating cylinder 7 and enter the cooling chamber 20 of the cooling cylinder 9. The cooling chamber 20 is continually maintained surrounded with cooling water, and within this cooling chamber 20, the tubes 30 are nearly cooled down to normal ambient temperatures. Having finished undergoing the bright annealing process and treatment, the tubes 30 are then removed from cylinder 9 and placed upon the delivery table 11.

The conventional continuous bright annealing furnace of the type described hereinabove has exhibited several problems. For example, while the mesh belt 21 passes through the retort 13 of the heating cylinder 7, the high temperatures within the approximate range of 1000– 1100° C within the interior portion thereof, and the weight of the mesh per se, along with that of the tubes 30, cause belt elongtation. Moreover, frictional resistance is increased by such high temperatures. As a result, because the strength of the mesh belt cannot withstand the resulting high loads, the belt becomes abnormally elongated within a short period of time, and when the belt 21 becomes so elongated, it is liable to become misaligned with respect to the adjustment wheels 3, the driving wheels 4, the holding wheels 5, and the like, and in extreme cases may become detached from the entrance-side guide wheels 2.

Furthermore, immediately prior to entering the heating cylinder 7, the tubes 30, and the lower portion of the mesh belt 21, are at normal ambient temperatures. Consequently, when the tubes 30 suddenly enter the high temperature environment interiorly of the retort 13, the great difference in the temperature distribution between the upper and lower sides of the tubes produces warping thereof, and the degree of warping may be such that the pipes touch the inner wall of the retort 13, and this can cause serious abrasive damage.

Still further, when the tubes 30 enter the cooling chamber 20 of the cooling cylinder 9, because the heat is retained within the mest belt 21, the tubes cannot undergo proper quenching within the short period of time essential to the annealing process. In addition, it is difficult to prevent the precipitation of chromium carbide. The tubes 30 are loaded directly upoon the mesh belt whereby metallic diffusion between the tubes and the belt 21 will occur at the positions at which they are in contact with one another due to the high temperatures involved. As is apparent from FIG. 2, the mesh belt 21 has a considerably large mass as compared with that of the tubes 30, and such is obviously disadvantageous for the rapid heating and quenching of the tube 30.

Referring then to FIG. 4, there is schematically shown a bright annealing furnace incorporating a conveying device constructed in accordance with the present invention. As shown, the bright annealing furnace comprises a serial arrangement of a product setting table 41, a cleaning cylinder 46, a heating cylinder 47, a cooling cylinder 49, and a product delivery table 70. Within the illustrated embodiment, the product is conveying in a linear fashion by means of a linear conveying element including an endless loop of wire or chain that passes through the cleaning cylinder 46, the heating cylinder 47, and over the product delivery table 70.

FIG. 5 shows a preferred embodiment wherein wire is utilized as the linear conveying element. The conveying device comprises a carrier 31 which supports the product, that is, the tubes 30, undergoing bright annealing and the carrier 31 is seen to include a connecting means 67, made of, for example, stainless steel rod, and arcuate-shaped long-article supports 68 disposed in line at suitable intervals along the longitudinal extent of rod 67*a*.

Details of the product carrier 31 are shown within FIGS. 5 and 6, wherein it is seen that the carrier 31 has at one end of the support rod 67*a*, a hook 69*a* which is utilized for engaging the wire 61*a*. The long-article supports 68 are arcuately shaped as shown within FIG. 6 so that they not only bear or support the tubes 30, but also function to hold the pipes or tubes in position while, as described later, they are passing through the retorts of the heating cylinder 47 and the cooling cylinder 49.

The conveying wire 61*a* is tensioned as shown within FIG. 4, by means of a guide wheel 42, disposed beside the entrance to the cleaning cylinder 46, an auxiliary guide wheel 43, and a free-floating or dancer-type wire stretch adjustment wheel 51. The driving section is disposed at the end adjacent to the product delivery section 70, and comprises a driving pulley 52, a pinch roller 53, an auxiliary driving pulley 54, auxiliary guide wheels 55 and 56, and a guide tube 63 disposed beneath the conveyor assembly.

The product carrier 31, comprising the carrier rods 67*a* and the product supports 68, is engaged with the conveying wire as follows. As can be seen within FIG. 4*a*, the carrier 31 is disposed upon the product setting table 41, utilizing the support guide groove 64 thereof, and subsequently, hook 69*a*, fixed at one end of the carrier rod 67*a*, is engaged, as shown within FIG. 5, with the wire 61*a* at a longitudinal position interposed between the guide wheel 42 and the cleaning cylinder 46. Within this condition, held by the wire 61*a*, the product carrier 31, together with the wire 61*a*, can move stably in a linear fashion. The bent configuration of the hook 69*a* and the resistance caused by the inclination of the wire 61*a* with respect to the hook 69*a* prevent slipping between the wire 61*a* and hook 69*a*, the wire 61*a* utilized for conveying being of a conventional type.

In order that a fixed rate of speed is stably imparted to such wire and to prevent abnormal wire elongation and uneven driving speed, the present invention employs the driving apparatus shown within FIG. 7. In order to prevent distortion of the wire 61*a* and to impart a constant tension thereto, a spring 50 is disposed upon the elongation adjustment wheel 51, which is free-floating, and in order to ensure driving of the wire 61*a* at a constant rate of speed and to prevent the wire from becoming unevenly wound around the drive mechanism, a plurality of grooved pulleys 52 are installed upon the shaft of the driving motor 72.

In order to prevent the wire 61*a* from coming out of the grooves of pulleys 52, the pinch roller 53, which may be made of, for example, rubber or other similar material, is provided in conjunction therewith, and in order to impart additional adjustable tension to the wire 61*a*, there is provided in addition to the spring 50 and the wheel 51, a grooved auxiliary pulley 54 which additionally serves to prevent slipping between the wire 61*a* and the driving pulley 52, as well as auxiliary guide wheels 55 and 56 which are operative in conjunction with the elongation adjustment wheel 51. The delivery table 71 is also disposed within the product delivery section 70, and the cross-sectional shape of table 71 is as shown within the cross-sectional view 4*a* as taken along the line E—E of FIG. 4.

Within FIG. 4, it is feasible for the cleaning cylinder 46 to be of fundamentally the same configuration as the cleaning cylinder 6 shown within FIGS. 1 and 2, however, for the design shown within FIG. 4*b*, the cleaning cylinder must be configured so as to correspond to the product supports 68 of the product carrier 31. Moreover, within the heating cylinder 47, the retort 65 is also of cylindrical cross-section and is disposed within the center of an enclosure built of insulating refractory brick, as shown within FIG. 4*c*, the retort incorporating heating elements 62 and an observation passageway 66.

As best shown within FIGS. 4*d* and 8*a*–8*c*, the cooling cylinder 49 has within the center of the body, an enclosed cooling water jacket 57 equipped with a cooling water inlet 58 and a cooling water outlet 59, the cooling chamber 60 being disposed within jacket 57. Upon the underside of the cooling chamber 60, a gas supply chamber 48, with a supply inlet 48*a* is installed, and a large number of openings 60*a* are formed within the lower portion of chamber 60 and are interconnected with inlet 48*a* so as to be provided with hydrogen gas.

The nuclear fuel clad stainless tubes 30 are bright annealed within the bright annealing furnace disclosed hereinabove in the following manner. A plurality, for example, five lengths, of tubes 30 are initially loaded in a side by side fashion upon the product supports 68 which is in turn disposed above the rod 67*a* of the product carrier 31 as seen within FIGS. 6 and 8*c*. Subsequently, at a point near the front end of the carrier 31 the front end of the tubes are loosely bound together by means of wire, leaving them free from the front end thereof toward the rear. The hook 69*a* is engaged with the wire 61*a* between the guide wheel 42 and the cleaning cylinder 46, as seen within FIG. 4, and since the cleaning cylinder 46, the retort 65 of the heating cylinder 47, and chamber 60 of the cooling cylinder 49 are all cylindrically shaped, the product supports 68, because of their configuration, will remain in a stable position during both moving and stationary operational periods due to gravitational forces impressed thereon, the same nevertheless being easily and smoothly moved by means of the wire 61*a* and the support rod 67*a*.

The wire 61*a*, support rod 67*a*, and the product supports 68 having entered into the retort 65 of the heating cylinder 47 rapidly absorb heat from the inner wall of the retort 5, the heat reaching the tubes 30 in a likewise extremely rapid manner. Consequently, the present invention is quite unlike the instance of the prior art, as shown within FIGS. 1–3, within which heat transfer is accomplished through means of the mesh belt 21 and there is the requirement for a considerable period of time to be undertaken in order to evenly heat the belt and wherein a subsequent difference in temperature between the upper and lower portions of the pipes 30 occurs. As stated previously, such a phenomenon can cause the tubes to become distorted while passing through the retort and therefore contact the inner wall thereof causing abrasion defects to occur. Within the present invention, however, a rapid, even heating of the tubes or pipes occur, and distortion is effectively prevented.

The tubes 30, having undergone a rapid heating processing at the predetermined temperature for the requisite period of time, now enter the cooling cylinder 49, and while they are passing through the chamber 60 of cylinder 49, they are rapidly cooled by means of the hydrogen gas projected through the openings 60*a* leading into chamber 60, the tubes being maintained within a surrounding envelope of a sufficient volume of such gas, due to the configuration of the product carrying devices 67 and 68 of the present invention and the characteristics of the conveying wire 61*a*. Furthermore, the product carrying devices 67 and 68 and the wire 61*a* are all relatively thin in cross-section, and consequently, the heat capacity of such components is small whereby the tubes 30 can in fact be quenched extremely effectively.

The tubes 30, loaded upon the product carrying devices 67 and 68, are subsequently, after passing through the cooling cylinder 64, disposed upon the table 71 of the product delivery section 70 by disengaging the wire 61*a* from the product carrying devices 67 and 68.

The description noted hereinabove is for an embodiment of apparatus of the present invention for conveying long articles within a bright annealing furnace, however, it is needless to note that the present invention can similarly be applied to various other heat treatment furnaces, wherein the same operational advantages can be achieved.

Within the embodiment described hereinabove, adjacent product carries are connected by means of a steel rod or shaft 67*a*, however, it is apparent that it is equally permissible to use a chain 67*b* in lieu thereof, because the function and effect thereof are not different such results of the previous means.

Within the embodiment shown within FIG. 9, along the wire 61*a* which is utilized as the two linear conveying elements, there is disposed a plurality of product supports 68, the foremost one of the supports having the aforementioned hooks 69*a* as the engaging means which engage the wire 61*a*, as shown within the Figure. Adjacent product carriers 68 are connected together by means of chain 67*b*, and thus, another embodiment of the present invention is applicable to system of the present invention.

As is apparent from the above-mentioned embodiments, any connecting means that can transmit the driving force from the foremost product carrier to the succeeding product carrier, and has sufficient strength for performance and maintenance of the operation, can be used as the connecting means for product conveyance within such furnaces, and therefor, in addition to the materials mentioned above, wire or other similar material may be used as the connecting means.

Another embodiment of the present invention is disclosed within FIG. 10 wherein tong-type clips 69*b* are used as the engaging means, each of the clips 69*b* having a gripper member 74 shaped so as to grip the linear conveying element and being pivotable about a pin bolt 73. Beyond bolt 73, at the end opposite gripper 74, wires 75 and 75', used as the connecting means, are attached thereto, and the ends of these wires are united at the end of a single wire serving as the product carrier 31 having product supports 68 firmly fixed thereto.

With this arrangement, the product support may be various lengths depending upon the product loaded thereon, and with the clip 69*b* engaged with the linear conveying element, and with the bolt 73 tightened as far as necessary, the linear conveying element is set in motion, pulling the cables 75 and 75' radially inwardly as shown by means of the arrows within the Figure. Thus, the gripper arms are correspondingly forced radially inwardly as the arrows show, so as to hold the linear conveying element more and more firmly, whereby the same may drive the product carrier 31, together with the product supports 68, so as to thereby convey the product.

Still another embodiment of the present invention is disclosed within FIG. 11 wherein a chain is used as the linear conveying element, and as the essential conditions required of the linear conveying element are that it can fully transmit the driving power from the driving mechanism to the engaging means of the product carrier, and also have sufficient strength for performance and maintenance of the operations, this embodiment employing a chain is an effective conveying device for use within heat treatment furnaces operated at comparatively low temperatures.

Such an embodiment is so limited because, as will be remembered in discussing the prior art, if the chain is used within a very high temperature heat-treatment furnace, elongation of the chain will undoubtedly occur, although such will be comparatively small by comparison with the mesh belt used within the prior art system. As a result, the chain will sometimes become unevenly wound about the adjustment wheels, driving pulleys, and the like. However, by comparison with the mesh belt of the prior art, this embodiment has a very small heat capacity, and thus, is very effective for imparting a uniform temperature distribution to the products within the furnace. Furthermore, it is feasible to fix the engaging means 69*c*, as in this embodiment, directly to the product carrier.

Whichever one of the variations of the present invention are used, that is, a wire 61*a* or chains 61*b* for the linear conveying element, a linear shaft 67*a* or a chain 67*a* for the product carriers, product supports 68, and hooks 69*a* and 69*c*, or clips 69*b*, outstanding results by means of bright annealing can be readily achieved due to the fact that, instead of using material of large cross-section and high heat capacity for the conveying belt or product carriers as within the prior art, in accordance with the present invention, other materials of small cross-section, such as, for example, 6 mm in diameter (28 $mm^2$) steel wire or rod are used for the product support rod 67, and coreless, $0.7\phi \times 7 \times 6$ strand wire (18$mm^2$), or other similar material for the conveying wire, are utilized, and moreover, because such are wires or rods, the products 30 always undergo direct and rapid heating and cooling, and consequently, swift heating and quenching can be expected.

Furthermore, due to the small cross-section of these materials, the full cross-sectional area of the chambers 65 and 60 for heating and cooling can be utilized, and accordingly, heating and cooling provided by means of these chambers is always evenly distributed over the entire working surfaces thereof, and thus, there is no danger or distortion of the chambers, nor of abrasion occuring therewithin. In addition, when quenching takes place, since the tubes 30 are directly and completely exposed to the quenching gas, the temperature thereof can be lowered by more than 400° C within a time period of 60 sec, and consequently, precipitation of chromium carbide can therefore be readily prevented.

FIG. 12 shows the temperature response characteristics for heating and cooling, in the instance of the application to a bright annealing furnace, for the conveying mechanism utilized within the prior art as well as for that used within the present invention, and within such graphical plot, the conveying device of the prior art is the mesh belt shown within FIGS. 1–3, while that used in accordance with the present invention is the mechanism shown within FIGS. 4–8.

The respective observations were made under identical experimental conditions, and with reference to the diagram, it is apparent that there are distinct differences between the time periods required by the product to reach a stable temperature immediately after entering the heating and cooling chambers. In the case of the mesh belt type conveying device, the rate of heating and cooling curve is limited because of the high capacity of the conveying mechanism itself, and in the instance of stainless steel pipe being treated, it is difficult to prevent precipitation of chronium carbide in spite of the importance thereof.

Comparing the time periods required for the temperature to fall by 400° C, the mesh belt conveying system shown within FIG. 1 requires approximately 2½ times as long as the system of the present invention, and comparing the time periods required to reach furnace temperature, the former requires twice as much time as the latter. These differences are entirely due to the difference between the conveying mechanism used.

Thus, according to the present invention, high-grade precision tubes, such as, for example, nuclear fuel clad stainless tubes utilized within nuclear power generation plants, can undergo continuous bright annealing, and this can only be achieved by this type of intra-furnace conveying. Advantages obtained by the present invention may then be summarized as follows:

Firstly, the problem of preventing precipitation of chromium carbide produced during annealing of the product has been resolved, and in addition, abrasion, frequently produced upon the product surface while within the heating cylinder, is effectively eliminated.

Secondly, commercially available wire can be used as the conveying element material, and from an economic viewpoint, the use of such low cost materials is much more advantageous than using a mesh belt mechanism which is a specially manufactured mechanism of high price. Moreover, as wire can be used, its driving mechanism functions stably, and the occurrence of operational problems, normally caused by elongation, can be readily prevented, whereby the entire driving section can be simplified and stabilized. Of course, the facilities within the furnace can also be simplified and the furnace chambers can be effectively utilized, and as a result, an increased quantity of products can be treated within a predetermined period of time thereby improving furnace productivity.

Thirdly, rapid heating and quenching, which are most important functions, are possible to attain without the necessity for employing highly priced gas and forced-cooling apparatus therefor, or the like. Since the conveying speed can also be faster, coupled with an increase in the quantity of product that can be treated within a predetermined period of time, efficiency is greatly improved. Moreover, the product carriers can be easily connected to the wire, and thus, much time otherwise required to be spent in setting-up the apparatus is eliminated, such considerably contributing to an efficient continuous treatment.

Fourthly, maintenance of the conveying mechanism is simplified. There is no danger of the product carriers becoming disengaged or the cable becoming detached, and one or two workers are sufficient for maintenance of the system.

Viewing all these advantages, it is apparent that the conveying apparatus of the present invention, for conveying long articles within heat treatment furnaces, has great value from an industrial viewpoint.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by Letters Patent of the United States is:

1. A conveying device for use within a heat treatment furnace for especially conveying long articles to be heat treated, which has at least one product carrier being capable of supporting said long articles, and a drive means for driving said product carrier, wherein the improvement comprises:

said drive means comprises at least one linear conveying element driven by a drive mechanism and disposed within said heat treatment furnace so as to be disposed upon the floor surface of said furnace; and at least the foremost one of said carriers disposed along the longitudinal direction of said conveying element comprises one or more product supports and an engaging means for engaging said conveying element, said product supports being of a length substantially shorter than that of said articles and being fixedly supported upon the upper surface of said conveying element such that substantially the entire portion of each of said product supports is disposed above and separated from said floor surface of said furnace so as to improve the heating and cooling efficiency of said articles.

2. A device as set forth in claim 1, wherein said product carrier further includes:

at least an additional product carrier, having a product support, disposed along the longitudinal direction of said conveying element and connected to the forward carrier by connecting means.

3. A device as set forth in claim 1, wherein:
said engaging means is a hook.

4. A device as set forth in claim 1, wherein:
said engaging means is a clip.

5. A device as set forth in claim 1, wherein:
said linear conveying element is a wire.

6. A device as set forth in claim 1, wherein:
said linear conveying element is a chain.

7. A device as set forth in claim 1, wherein:
said drive mechanism includes an adjustment wheel for imparting a constant tension to said linear conveying element.

8. A device as set forth in claim 2, wherein:
said connecting means comprises a linear element.

9. A device as set forth in claim 8, wherein:
said linear element is a wire.

10. A device as set forth in claim 8, wherein:
said linear element is a chain.

11. A device as set forth in claim 8, wherein:
said linear element is a rod.

12. A device as set forth in claim 1, wherein:
said product support has an arcuate-shaped vertical cross-section disposed transversely of the direction of movement of said product.

13. A device as set forth in claim 1, wherein:
said linear conveying element is endless.

* * * * *